US006776417B1

(12) United States Patent
Holgate

(10) Patent No.: US 6,776,417 B1
(45) Date of Patent: Aug. 17, 2004

(54) DISC GOLF TARGET

(75) Inventor: Michael S. Holgate, Charlotte, NC (US)

(73) Assignee: Holgate Inc., Charlotte, NC (US)

( * ) Notice: Subject to any disclaimer, the term of this patent is extended or adjusted under 35 U.S.C. 154(b) by 0 days.

(21) Appl. No.: 10/417,442

(22) Filed: Apr. 16, 2003

Related U.S. Application Data

(60) Provisional application No. 60/372,755, filed on Apr. 16, 2002.

(51) Int. Cl.[7] ..... A63B 67/06
(52) U.S. Cl. ..... 273/400; 473/476
(58) Field of Search ..... 273/398–402; 135/15.1, 66

(56) References Cited

U.S. PATENT DOCUMENTS

| | | | | | |
|---|---|---|---|---|---|
| 3,414,133 | A | * | 12/1968 | Innocenti et al. | 211/107 |
| 4,039,189 | A | | 8/1977 | Headrick et al. | |
| 4,461,484 | A | | 7/1984 | Headrick | |
| 4,792,143 | A | | 12/1988 | Headrick | |
| 4,809,988 | A | * | 3/1989 | Hunter | 273/400 |
| 5,048,845 | A | | 9/1991 | Dunipace | |
| 5,303,931 | A | | 4/1994 | Brown | |
| 5,358,255 | A | | 10/1994 | Jolson | |
| 5,397,130 | A | | 3/1995 | Brown | |
| 5,452,903 | A | | 9/1995 | Larrabee | |
| 5,868,395 | A | | 2/1999 | Headrick | |
| 5,893,563 | A | * | 4/1999 | Buller | 273/400 |
| 5,921,551 | A | | 7/1999 | Dunipace | |
| 5,941,529 | A | * | 8/1999 | Kinsey | 273/401 |
| 5,944,318 | A | * | 8/1999 | Payton | 273/402 |
| 6,250,635 | B1 | | 6/2001 | Chittenden | |
| 6,468,165 | B1 | * | 10/2002 | Moore | 473/170 |
| 6,494,455 | B1 | * | 12/2002 | Headrick | 273/400 |
| 2001/0017150 | A1 | * | 8/2001 | Doreste | 135/15.1 |
| 2003/0025272 | A1 | * | 2/2003 | Billig et al. | 273/400 |

* cited by examiner

*Primary Examiner*—Mark S. Graham
(74) *Attorney, Agent, or Firm*—Miller, Everman & Bernard, PLLC; Gregory R. Everman

(57) ABSTRACT

A disc golf target having an improved configuration for providing uniform, more consistent disc capture. The target includes a canopy assembly and a basket assembly attached to a center pole. A tripod base is used to support the target. A chain assembly is attached between the canopy and basket assemblies for absorbing kinetic energy from an incoming disc thereby capturing the disc. The chain assembly includes a continuous upper chain, attached to the canopy assembly and extending 360 degrees, a plurality of deflection members hanging from the upper chains, and a continuous lower chain functionally coupled to the lower end of said deflection members. The deflection members are attached to the canopy and basket assemblies in an alternating pattern in which a first deflection members are attached at the canopy assembly and adjacent second deflection members are attached at the basket assembly. The canopy and basket assemblies are quickly collapsible.

18 Claims, 5 Drawing Sheets

62
60
60
74
74
64
50
64
68
72
70
76
16
138
138
80
22
140
50
12
64
140
10
130
20
134
134b
134
134a
26
134a
24
134b
114
98
100
110
98
112
18
96
92
112
90
112
150
150
132
94
96
120

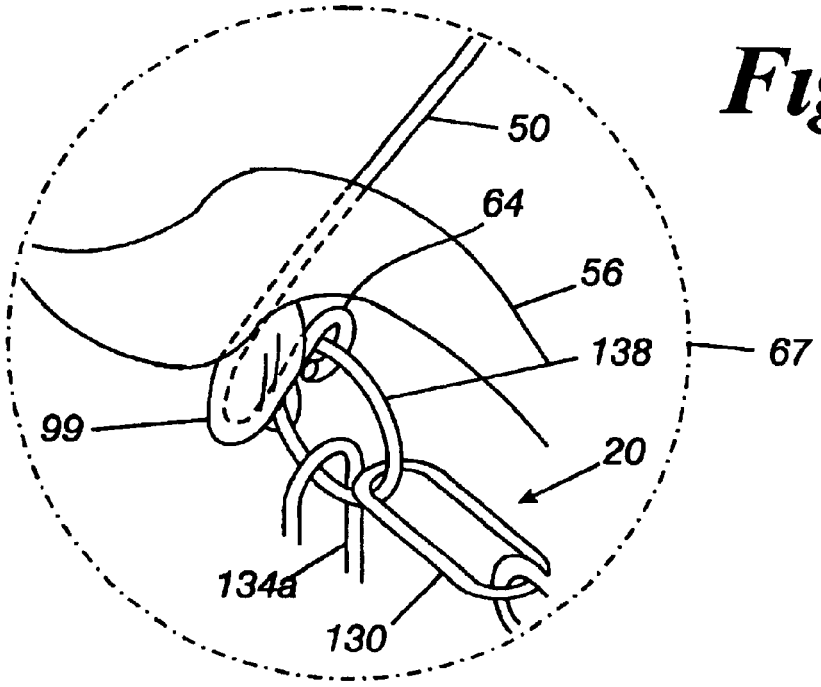
Fig.10
Fig.11
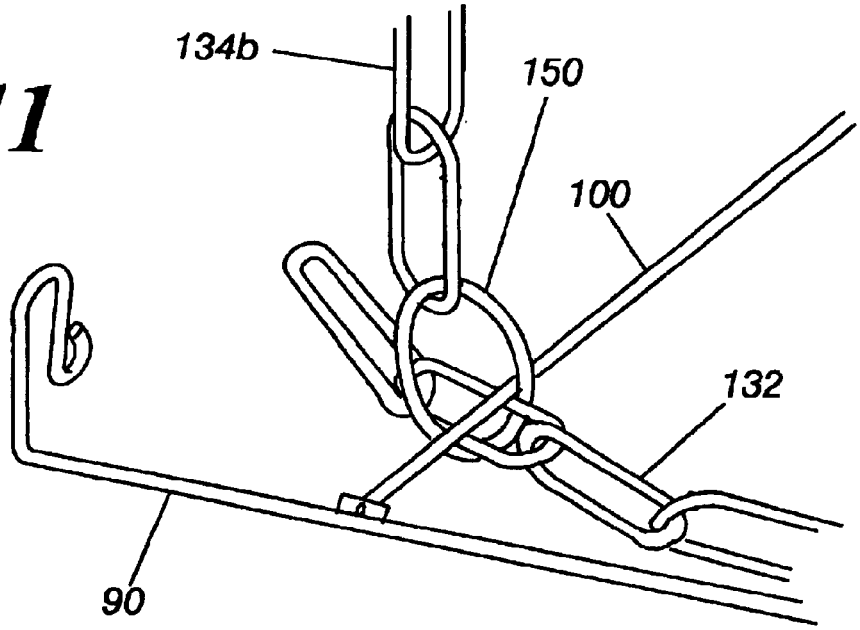

DISC GOLF TARGET

CROSS REFERENCE TO RELATED APPLICATION

This application claims the benefit of U.S. Provisional Application No. 60/372,755, filed Apr. 16, 2002.

FIELD OF THE INVENTION

The present invention relates generally to target apparatuses for disc golf games, and more particularly to a disc golf target configured for improved and consistent disc capture, and which is easily collapsible for portability.

BACKGROUND OF THE INVENTION

Disc golf is increasingly growing in popularity. The game is typically played on courses laid out in parks or other recreational areas. A course consists of a number of "holes", such as nine or eighteen, with each hole having a 'tee box' from which a disc is originally thrown by each player and a target 'hole' positioned at a selected distance from the tee.

In playing disc golf, a disc is thrown from a tee box in a direction of the respective hole. After the throw, the player picks up the disc at its point of progression, and again throws the disc towards the target. This process is continued until the disc is captured within the target, completing the hole. After all the holes are played, the number of throws required to complete each hole is added to provide a total score.

While several different types of targets are in use, most have some form of basket or other receptacle and an upper frame which are mounted on a post or other support. A plurality of chains loosely hang from the upper frame above the basket. The chains are functionally arranged to catch a disc by absorbing its kinetic energy so that the disc drops into the basket.

U.S Pat. Nos. 5,868,395; 4,039,189; and 4,461,484, each to Headrick, are representative of conventional disc golf target. In general, these patents disclose a chain assembly that hangs at an upper end from an upper frame and is attached at its lower end to a center pole. A basket is provided below the chain assembly for capturing a disc as it is deflected downwards by the chain assembly. The chain assembly provides a target having a parabolic profile that is wider at the top of the assembly than the bottom. This profile shape is inherently inconsistently as a target area since discs which strike the upper target area are often captured, whereas discs on the same vertical line, but which strike the bottom of the target area, are more likely to strike near the outer edge of the chain assembly and escape capture.

Conventional targets are typically configured so that the bottom of the chain assembly is attached to a center ring that is slidably disposed around the center pole. The chain assembly and center ring act as unitary mass which absorbs kinetic energy in order to stop and deflect an incoming disc. In particular, as the disc strikes the chain assembly, the chain assembly and center ring are caused to be lifted to counteract the force of the engaging disc. After the disc strikes the chain assembly, the center ring will fall back to its original position, causing the chain assembly to rebound. Disadvantageously, this forceful recoil may cause the disc to be ejected out of the target rather than allowing it to penetrate the chains and drop into the basket below.

Another disadvantage of disc golf targets that utilize a center ring attenuation system is that occasionally a disc may pass through the target after initially receiving the disc. This undesired outcome may occur since when the disc strikes the target all the chains are affected chaotically prior to rebound. The chaotic movement of the individual chains sometimes creates a 'window' through which the disc may escape from the target.

One prior art attempt to resolve the 'window' problem was to provide a second, inner ring of chains to deflect the disc into the basket. While the second ring of chains may increase the capture efficiency of discs, the additional structure adds cost, weight and complexity to the target.

Another shortcoming of conventional disc golf targets is their inability to provide for equally adequate deflection and capture of discs striking the target at various velocities, and for disc of various diameters and weights. This problem is partially due to the parabolic profile of typical target areas, wherein the spacing between the chains, and mass that the disc engages, various according to the height at which the disc strikes the target. Another cause of the deficiency is the manner in which the chain assembly is configured and functionally attached to a center ring.

Conventional targets are also limited in that have a rigid upper support and a ribbed, bulky basket, which are not collapsible. As such, the target must be time-consumingly disassembled in order to package, transport, or store.

A further deficiency of conventional targets is that their ribbed, rigid basket construction hosts sharp edges, welding flashes, and blunt angles, that may chip, gash or otherwise damage golf discs that impact these points. Discs may also become wedged between the ribbed members of the basket and, occasionally, may improperly hole out by passing through the side of the basket. Another limitation caused by the rigid basket construction is that discs that are deflected into the basket may bounce up and out of the target, causing the player to make another throw.

Applicant is aware of the following U.S. Patents concerning disc golf targets.

| U.S. Pat. No. | Inventor | Issue Date | Title |
|---|---|---|---|
| 6,250,635 B1 | Chittenden | Jun. 26, 2001 | DISC GOLF TARGET |
| 5,921,551 | Dunipace | Jul. 13, 1999 | DISC GOLF TARGET |
| 5,868,395 | Headrick | Feb. 9, 1999 | DISC-CATCHING DEVICE |
| 5,452,903 | Larrabee | Sept. 26, 1995 | AUDIBLE FLYING DISC TARGET ASSEMBLY |
| 5,397,130 | Brown | Mar. 14, 1995 | PORTABLE FLAG-TARGET FOR FLYING-DISC GAME AND METHOD OF MANUFACTURE THEREFOR |
| 5,358,255 | Jolson | Oct. 25, 1994 | DISC CATCHING APPARATUS |
| 5,303,931 | Brown | Apr. 19, 1994 | PORTABLE FLAG-TARGET FOR FLYING-DISC GAME AND METHOD OF MANUFACTURE THEREFORE |
| 5,048,845 | Dunipace | Sept. 17, 1991 | ENTRAPMENT ASSEMBLY |
| 4,792,143 | Headrick | Dec. 20, 1998 | FLYING DISC ENTRAPMENT ASSEMBLY |
| 4,461,484 | Headrick | Jul. 24, 1984 | FLYING DISC ENTRAPMENT ASSEMBLY |
| 4,039,189 | Headrick et al. | Aug. 2, 1977 | FLYING DISC ENTRAPMENT DEVICE |

SUMMARY OF THE INVENTION

The present invention provides a disc golf target for being a target in a disc golf game. The disc golf target consist of a canopy apparatus and a basket apparatus, each attached to a center pole, and a chain assembly for deflecting discs into the target. The target is configured to provide improved and consistent capture of discs that engage the target. Moreover, the target has a lightweight construction that is easily collapsible in order to facilitate transport and quick set-up of the target.

In the broadest sense, the present invention relates to a disc golf target for the capture of disc thrown thereat, in which the target includes a canopy assembly, a basket assembly and a chain assembly attached between the canopy and basket assemblies. The chain assembly includes a plurality of deflection members for absorbing kinetic energy from an incoming disc in order to deflect the disc into the basket assembly.

In the broadest sense, the present invention also relates to a disc golf target having a center pole, a first skin, and means for opening and closing the first skin. The target also includes a second skin, and means for opening and closing the second skin.

OBJECTS OF THE INVENTION

The principal object of the present invention is to provide an improved disc golf target that has consistent capture efficiency of discs that engage the target.

Another object of the invention is to provide a disc golf target that efficiently captures discs traveling at various speeds, having a range of diameters, and of different mass.

Another object of the invention is to provide a disc golf target that provides a uniform target area for the capture of discs.

A further object of this invention is to provide a disc golf target that is simply and easily collapsible for transport and storage.

Another object of the invention is to provide a disc golf target that is lightweight for easy carrying.

Another object of the invention is to provide a disc golf target that has a basket formed of a fabric skin, wherein the skin protects golf discs that strike the basket from wear and damage.

DESCRIPTION OF THE DRAWINGS

The foregoing and other objects will become more readily apparent by referring to the following detailed description and the appended drawings in which:

FIG. 10 is a fragmented perspective view of a detail of FIG. 1, showing one of the canopy ribs inserted into a pocket of a canopy skin for holding open the skin; and FIG. 11 is a fragmented perspective view of a detail of FIG. 9, showing an attachment of the chain assembly to the lower rib assembly.

DETAILED DESCRIPTION

The present invention is a disc golf target for the intended purpose of serving as a target for a disc golf game. The target is uniquely configured to provide improved and consistent capture of discs that engage the target. Moreover, the target is configured to have a lightweight construction and is easily collapsible in order to facilitate transport and quick set-up of the target. Other advantages of the invented disc golf target are provided by the use of fabric skins which form part of a basket assembly and part of a canopy assembly. The skins not only improve the appearance of the target, but also account for a reduction in weight and a reduction in the amount of structural members required by the target.

Figure 1:
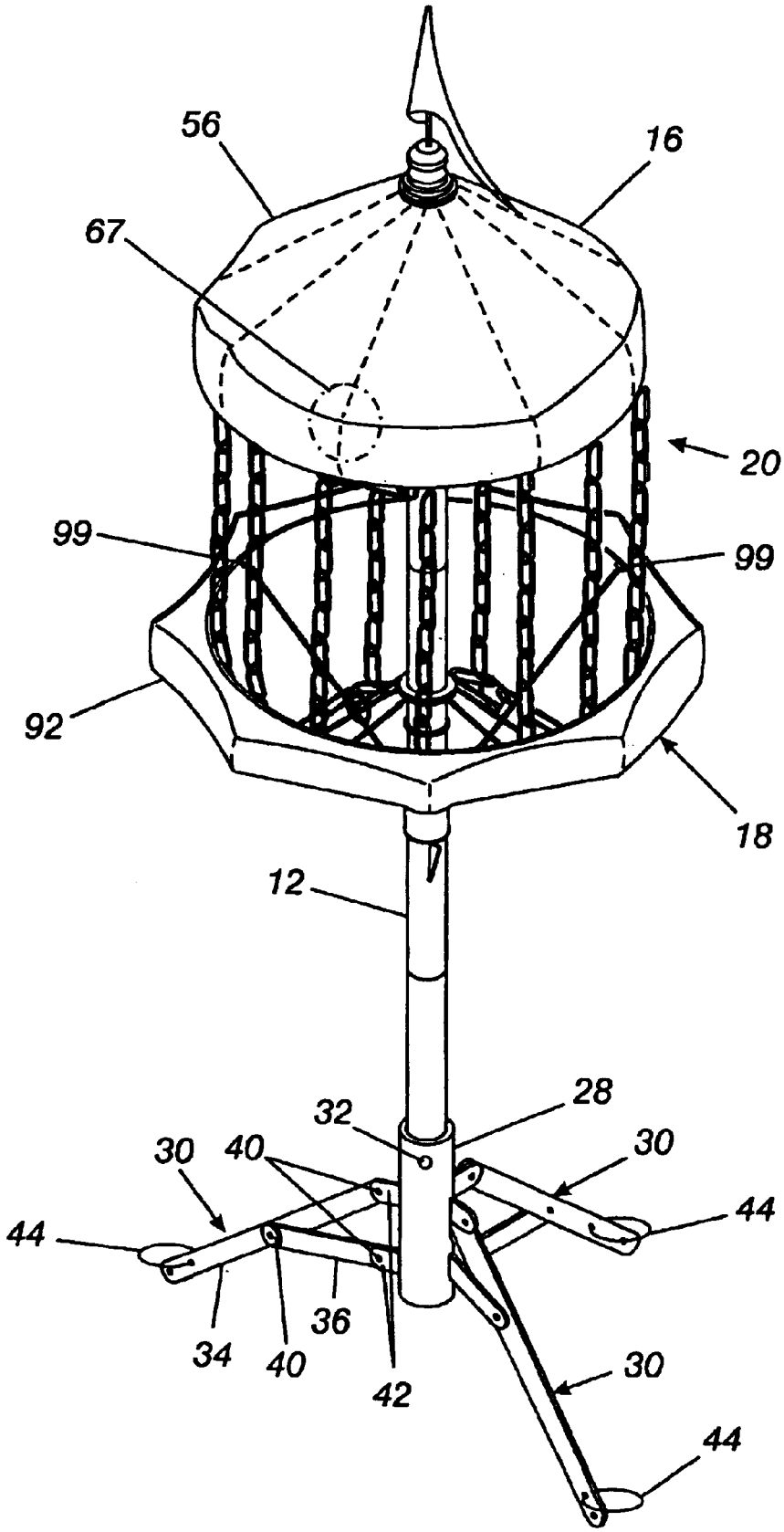
FIG. 1 is a perspective view of the invented disc golf target, taken from above target.

Referring now to the drawings, and particularly to FIG. 1, the invented disc golf target 10 includes a center post 12, a tripod base 14 for supporting the target 10, a canopy assembly 16, a basket assembly 18 for holding a disc, and a chain assembly 20 for stopping and deflecting a disc into the basket assembly 18.

Figure 9:
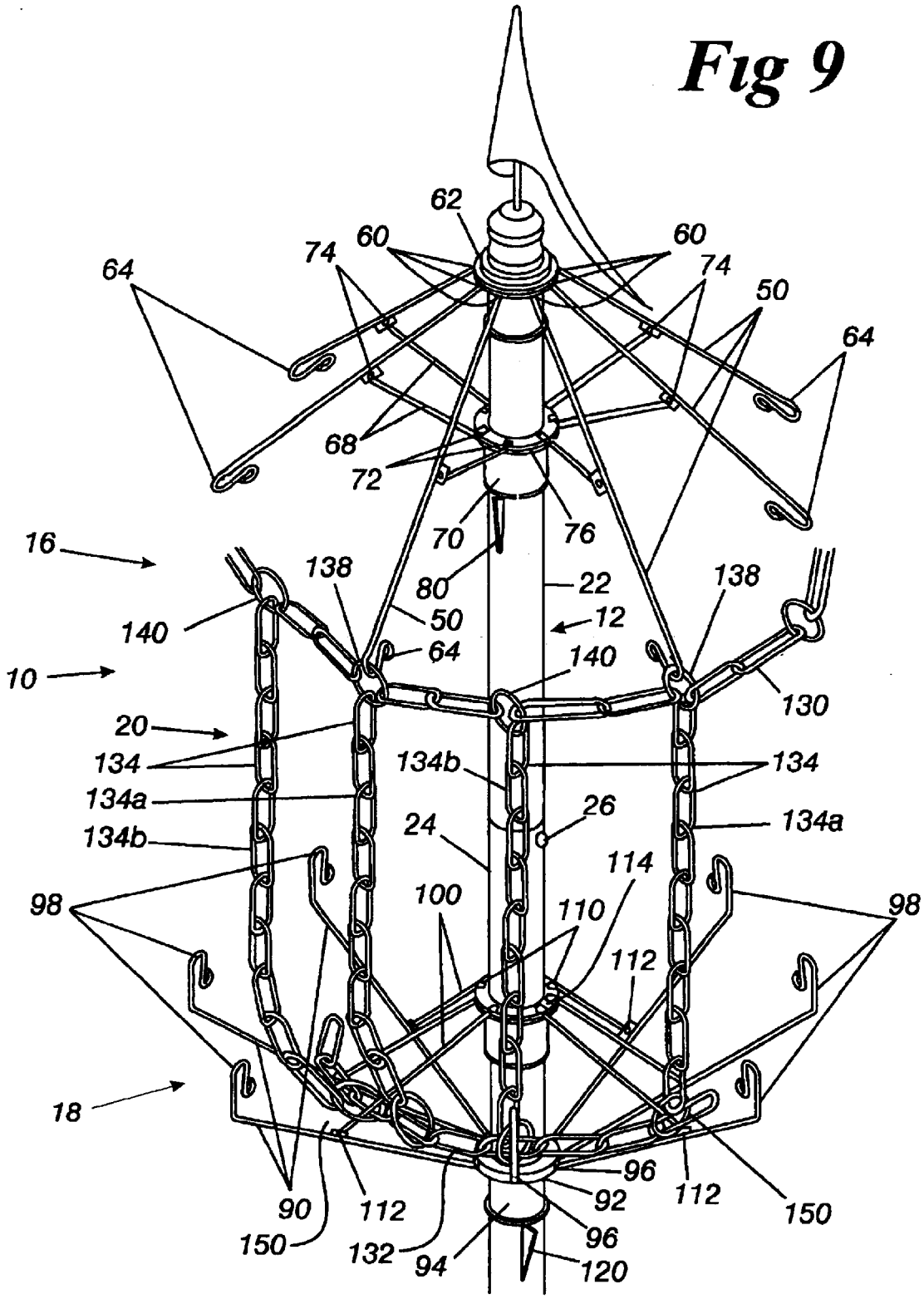
FIG. 9 is a fragmented perspective view of the disc golf target of FIG. 1, having its upper and lower skins removed, showing upper and lower rib assemblies and partially showing a chain assembly.

As illustrated in FIG. 9, the center post 12 is sectionally configured with a first section 22 and a second section 24. The first section 22 carries a spring loaded detent 26 which is received through an opening in the second section 24 to join the sections 22, 24 together. The sections 22, 24 may be detached from each other for shipment, or the like, by depressing the detent 26, then pulling the sections 22, 24 apart.

As illustrated by FIG. 1, the center post 12 is firmly held in place by the tripod base 14. The tripod base 14 comprises a tubular shaft 28 that receives and holds the center post 12 and three leg assemblies 30. A spring loaded detent 32 may be provided to releaseably secure the center post 12 to the tripod shaft 28. Each leg assembly 30 includes a leg 34 and a cross support 36 which are pivotally attached to each other and to the tripod shaft 28. Provided pivots 40 allow for the legs 34 to be spread apart in order to form a stable support for the disc golf target 10 and also to allow for the leg assemblies 30 to be closely collapsed for storage and transport. Brackets 42 may be provided to facilitate the inclusion of the pivots 40. Rings 44 may be provided at the terminal end of each leg 34 through which a respective stake may be received in order to anchor the disc golf target 10 to the ground.

Figure 2:
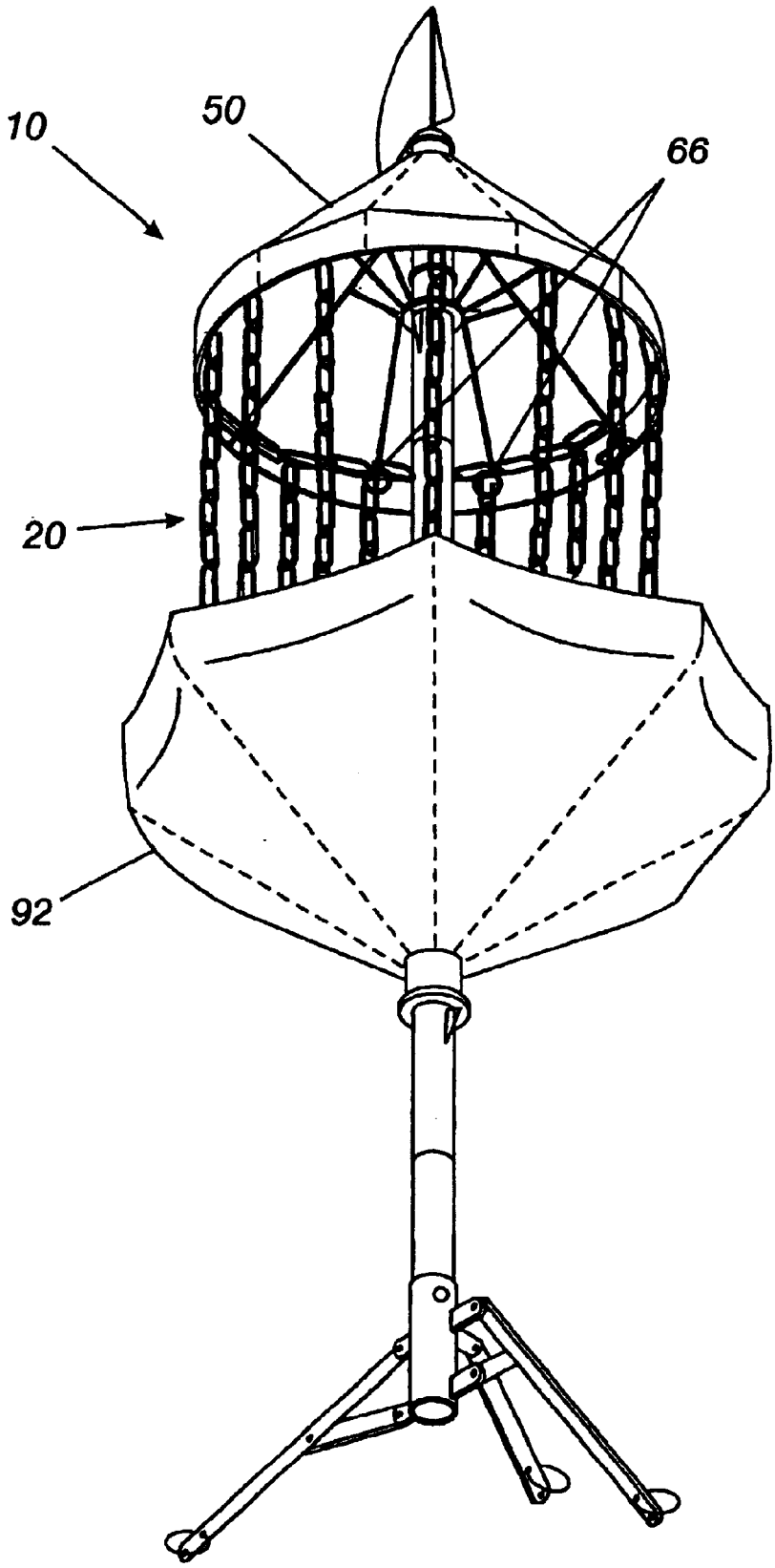
FIG. 2 is a perspective view of the disc golf target of FIG. 1, taken from below the target.
Figure 3:
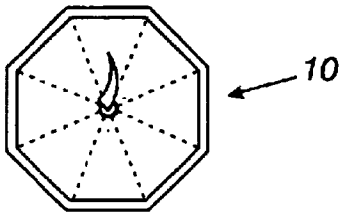
FIG. 3 is a top view of the disc golf target of FIG. 1.
Figure 4:
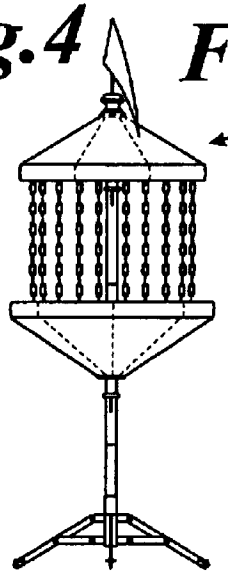
FIG. 4 is a front view of the disc golf target of FIG. 1.
Figure 5:
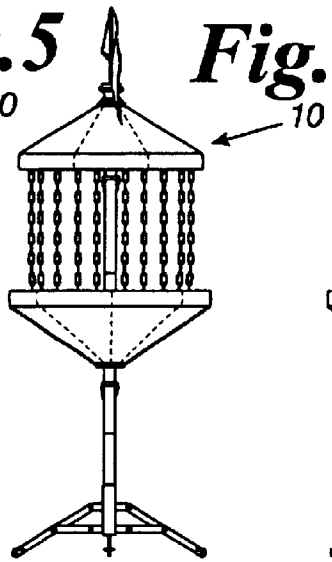
FIG. 5 is a right side view of the disc golf target of FIG. 1.
Figure 6:
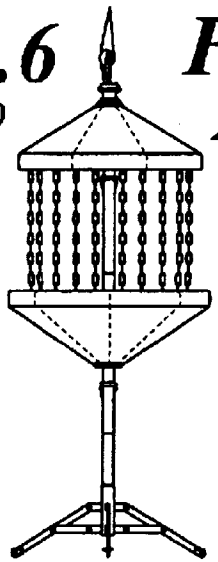
FIG. 6 is a left side view of the disc golf target of FIG. 1.
Figure 7:
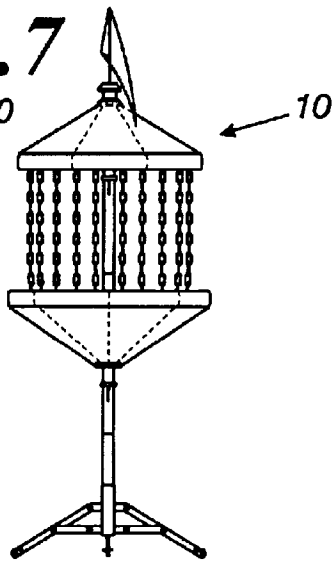
FIG. 7 is a rear view of the disc golf target of FIG. 1.
Figure 8:
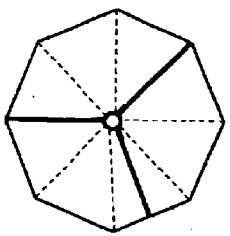
FIG. 8 is a bottom view of the disc golf target of FIG. 1.

Referring to FIG. 9, the canopy assembly 16 includes a canopy rib assembly having a plurality of canopy ribs and support ribs 68. The canopy ribs 50 that radially extend from the center post 12 in order to provide suitable structure to hold open a fabric skin 56 (FIG. 1). Each of the canopy ribs 50 are pivotally attached at a first end to the center post 12 by suitable means such as by pivots 60 provided in a flange 62. The second end of each canopy rib 50 is formed in a loop 64 which is inserted into a pocket 66 formed in the fabric skin 56, as illustrated in FIG. 2 and in greater detail in FIG. 10. The looped end 64 also forms the attachment from which the chain assembly 20 is hung.

The detail illustrated by FIG. 10 corresponds to the area identified in FIG. 1 by reference number 67, but with the canopy skin 56 pulled partially back to expose the pocket 66 and the canopy rib 50 inserted therein. The pockets 66 and canopy ribs 50 cooperate to hold the skin 56 open and to allow for the skin 56 to be easily removed. As such, a variety of canopy skins 56 may be applied to the target to change the look of the target. For example, the canopy skin 56 may be customized by screen-printing, embroidery or other graphic application methods in order to include sponsor logos or to otherwise enhance its appearance by applying a design to the skin. Referring to FIG. 1, the canopy skin 56 functionally reinforces the canopy ribs 50, forming a sturdy canopy assembly 16. Since the skin 56 reinforces the canopy ribs 50, fewer ribs or other framework are needed. That is, the skin replaces what would otherwise have been additional frame members, which would have added weight and bulk to the target.

Referring to FIG. 9, support is provided to each of the canopy ribs 50 by the support rib 68. The support ribs 68 are pivotally attached at a first end to a collar 70 and at an second end to an intermediate portion of the canopy ribs 50. Suitable pivots 72, 74 are provided to facilitate the necessary attachments. The collar 70 may additionally include a flange 76 to provide sufficient structure in order to accommodate the pivot points 72.

The collar 70 is slidably disposed on the center post 12. When the collar 70 is in an upmost position, the canopy assembly 16 is in the open position and ready for use. Specifically, as the collar 70 is moved upwards, the support ribs 68 force the canopy ribs 50 upward and outward, which in turn deploys the fabric skin 56 (FIG. 1).

A spring loaded lever 80 is configured with the center post 12 to maintain the collar 70, and thus the canopy assembly 16, in the deployed position. By depressing the lever 80 and moving the collar 70 downwards, the canopy assembly 16 may be quickly collapsed for transport or storage.

Referring to FIG. 9, the basket assembly 18 is larger than the canopy assembly 16 in order to encourage capture of thrown discs and has a configuration somewhat similar to that of the canopy assembly 16. In particular, the basket assembly 18 includes basket rib assembly having a plurality of basket ribs 90 and support ribs 100. The basket ribs 90 radially extend from the center post 12 in order to provide suitable structure to hold open a basket fabric skin 92 (FIG. 2). Each of the basket ribs 90 are pivotally attached at a first end to a flanged portion 92 of a collar 94 via suitable pivots 96. Referring to FIG. 1 in combination with FIG. 9, the second end of each basket rib 90 is formed in a loop 98 that is disposed within a respective pocket 99 formed in the fabric skin 92. The basket ribs 90 and pockets 99 cooperate to hold the skin 92 stretched over the basket ribs 90, and allows for the skin 92 to be easily replaced. The loop 98 also forms the attachment to which the chain assembly 20 is attached.

The basket skin 92 functionally reinforces the basket ribs 90, assisting in forming a sturdy basket assembly 18. As such, fewer ribs, or other framework, are needed to form the basket assembly, resulting in a lighter, less bulky, disc golf target 10.

In addition to aesthetics and structural support, the canopy and basket skins 56, 92 also provide a soft barrier which separates an incoming disc from the rigid canopy and basket ribs 50, 90. As such, the skins 56, 92 protect the discs from being nicked, gashed, or otherwise damaged, by the target framework.

Referring to FIG. 9, support is provided to each of the basket ribs 90 by the support rib 100. The support ribs 100 are pivotally attached at a first end to the center post 12 and at a second end to an intermediate portion of the basket ribs 90. Suitable pivots 110, 112 are provided at the point of attachment. The center post 12 may include a flange 114 in order to provide sufficient structure for supporting the pivots 110.

The collar 94 is slidably disposed on the center post 12. When the collar 94 is in an upmost position, the basket assembly 18 is in the open position ready for use. Specifically, as the collar 94 is moved upwards, the support ribs 100 force the basket ribs 90 outward and downward, which in turn deploys the basket skin 92 (FIG. 2).

The center post 12 is provided with a spring loaded lever 120 to maintain the collar 94, and thus the basket assembly 18, in the deployed position. By depressing the lever 120 and moving the collar 94 downwards, the basket assembly 18 can be quickly collapsed for easy transport or storage.

Referring to FIG. 9, the chain assembly 20 includes an upper chain 130, a lower chain 132, and a plurality of deflection members 134 attached there-between, forming a 'curtain' 360 degrees around the disc golf target 10. The deflection members 134 may be made of any suitable material, such as plastic and more preferably metal, which would cause an incoming disc to decelerate and deflect into the canopy assembly 18. This curtain is the target zone at which a player aims his disc for capture by the target 10. As illustrated by FIGS. 4–7, the target zone is the same size from every direction, and has a uniform rectangular profile.

The upper chain 130 is attached to the looped ends 64 of the canopy ribs 50, forming a continuous ring defining an upper boundary of the target zone. First deceleration chains 134*a* hang from links 138 on the upper chain 130 where the upper chain 130 is attached to the canopy ribs 50. Second deceleration chains 134*b* are hung from links 140 which from the midpoints of the upper chain 130 between the canopy ribs 50. The lower ends of the first chains 134*a* hang without being directly attached to any other structure. The lower ends of the second chains 134*b* are slidably attached to the basket support ribs 100. As such, the deceleration chains 134 are attached in an alternating pattern wherein the first chains 134*a* are attached to the links 138 at a canopy rib 50 and hang between the support ribs 90, while the second chains 134*b* are attached to the links 140 between the canopy ribs 50 and are attached at their lower ends to the support ribs 90. It is noted that in order to accomplish this alternating pattern, the canopy ribs 50 are offset from the support ribs 100 by a suitable angle, such as for example by 22.5 degrees when eight canopy ribs 50 and eight support ribs 100 are used.

This alternating pattern of the preferred embodiment provides superior disc capture, however, the disc golf target 10 may alternatively be configured so that the canopy ribs 50 and the support ribs 100 are in phase with each other, that is, in the same vertical plane. In this alternative embodiment, the first chains 134*a* would be attached at canopy ribs 50 and at the support ribs 90, and the second chains 134*b* would be disposed between the canopy ribs 50 and between the support ribs 90.

The deflection members 134 have sufficient slack so that they hang generally vertically in order to provide a target zone of uniform shape. In particular, the formed target zone is rectangular so that discs striking the upper part of the target zone have an equal chance of being captured as those which strike the lower part of the target zone. The slack also allows those deflection members 134 which are struck by a disc to move and allow the disc to enter through the chains 134 for capture.

The lower chain 132 is functionally coupled to the deflection members 134 by being disposed freely through bottom links 150 of the deflection members 134. Th lower chain 132 forms a continuous ring along the bottom of the chain assembly 20, and its mass serves as an anchor for the deflection members 134 and helps maintain the chain 134 in proper position. It is noted that in an alternative embodiment, the lower chain 132 may be attached to the deflection members 134 and/or to the support rib 100.

The basket support ribs 100 to which the second chains 134*b* are attached, slope upwards towards the center post 12. Preferably the support ribs 134*b* slope at least 15 degrees, more preferably in the range from 20 to 45 degrees, and most preferably about 30 degrees. The sloped support ribs 90 act against the second chains 134*b* when they are being forced inwards by being struck by a disc. The greater the applied force to the deflection members 134, due to a disc's impact, the greater the resistant force as the deflection members 134 are pushed up the inclined support ribs 90. As such, the disc golf target 10 automatically adjusts to accommodate for the speed and weight of a striking disc in order to maximize consistent capture thereof. The sloped support ribs 90 also cause the deflection members 134 to reset in a controlled, non-chaotic slide back to their original position after a disc has struck the target. As such, chain assembly rebound is obviated whereby discs are not ejected from the target 10 after being captured.

In operation, when a disc strikes the target area of the disc golf target 10 only the impacted deflection members 134 and those immediately adjacent thereto are disrupted, while the remaining deflection members 134 maintain their positional integrity. That is, due to the arrangement of the chain assembly 20, the manner in which it is coupled to the canopy and basket rib assemblies, the affected deflection members 134 are caused to move, absorbing kinetic energy from a striking disc and deflecting it into the basket assembly 18, and, chaotic response is inhibited in the remaining deflection members 134. Thereafter, affected second chains 134*b* that had been forced upward along the support ribs 134*b* during impact, gently slide back to their original position.

In cases where a disc manages to break the first plane of deflection members 134, the non-affected deflection members 134 remain in their original position forming a curtain to keep the disc from passing fully through the target 10. In particular, the deflection members 134 are configured to be easily movable inwards toward the center post 12, however, the chains 134 resist outward movement by having limited travel in the outward direction and thus are quickly placed in tension.

The vertical orientation of the deflection members 134 form an uniform target zone. Moreover, the disc golf target 10 effectively captures disc regardless if they strike at the center-line, or near a lateral edge, of the target zone. In particular, when facing the target zone, the foremost deflection members 134 slide the easiest inward towards the center post 12 when struck with by disc. In comparison, the deflection members 134 near the lateral edges of the target zone, if struck, would be placed in greater tension, thus providing greater resistance to the incoming disc. This affect creates a constant sweet spot whereby discs that impact at the center-line of the target zone are easily captured, and discs that impact near the lateral edges of the target zone face greater resistance and as such are drawn into target 10.

The disc golf target 10 is quickly collapsible by depressing levers 80 and 120 to respectively tightly fold-up the awing section 16 and the canopy assembly 18. The hinged tripod base 14 (FIG. 1) can also be quickly folded closed. The collapsed disc golf target 10 may then be easily handled and transported to a new location.

Chain assembly allows from fewer ribs to be used. Can fix both ends of deflection chains, without much slack, in order to make one side harder to get it in the target.

SUMMARY OF THE ACHIEVEMENT OF THE OBJECTS OF THE INVENTION

From the foregoing, it is readily apparent that I have invented disc golf target having an improved configuration for providing uniform, more consistent disc capture. Canopy and basket assemblies of the disc golf target are advantageously collapsible for easy transport and storage of the device. The target has a novel chain assembly that not only improves capture efficiency of discs, but does so with fewer structural members than typically associated with conventional disc golf targets. Further, replaceable canopy and basket skins applied to the target allow for customization and aesthetic changes to be easy made.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. A disc golf target, comprising:

a canopy assembly;

a basket assembly;

a chain assembly attached to said canopy assembly and to said basket assembly, wherein said chain assembly includes a plurality of deflection members; and wherein said canopy assembly and said basket assembly are collapsible, without requiring disassembly, in order to facilitate transport of said target.

2. The target according to claim 1 wherein said deflection members are generally vertically disposed.

3. The target according to claim 2 wherein said deflection members form a disc target area having a rectangular profile.

4. The target according to claim 1 wherein said deflection members include alternating first and second deflection members, wherein said first deflection members are attached at said canopy assembly and said second deflection members are attached at said basket assembly.

5. The target according to claim 1 further including a pole, wherein said canopy assembly is attached to said pole and includes a canopy rib assembly, and wherein said basket assembly is attached to said pole and includes a basket rib assembly.

6. The target according to claim 5 wherein said canopy rib assembly includes a plurality of canopy ribs radially extending from said pole and a plurality of canopy support ribs radially extending from said pole and supporting said canopy ribs, and wherein said basket rib assembly includes a plurality of basket ribs radially extending from said pole and a plurality of basket support ribs radially extending from said pole and supporting said basket ribs.

7. The target according to claim 6 wherein said second deflection members are attached at said basket support ribs.

8. The target according to claim 7 wherein said basket support ribs slope and at an angle downwards away from said pole when said basket assembly is in a deployed position.

9. The target according to claim 8 wherein the angle is at least 15 degrees.

10. The target according to claim 9 wherein the angle is in the range of 20 degrees to 45 degrees.

11. The target according to claim 6 wherein said canopy support ribs are pivotally attached at a first end to said pole and pivotally attached at a second end to said canopy ribs whereby said canopy assembly is positionable between a deployed open position and a collapsed closed position, and wherein said basket support ribs are pivotally attached at a first end to said pole and pivotally attached at a second end to said basket ribs whereby said basket assembly is positionable between a deployed open position and a collapsed closed position.

12. The target according to claim 1 wherein said canopy assembly and said basket assembly are fitted with removable skins.

13. A target for the capture of a disc, comprising:

a pole;

a canopy rib assembly attached to said pole;

a basket rib assembly attached to said pole;

a chain assembly attached to said canopy rib assembly and;

wherein said chain assembly includes a first continuous chain spanning 360 degrees and attached to said canopy rib assembly; a plurality of deflection chains attached to said first chain; a second continuous chain spanning 360 degrees and functionally coupled to said deflection chains.

14. The target according to claim 13 wherein said canopy rib assembly includes a plurality of canopy ribs radially extending from said pole, and wherein said basket rib assembly includes a plurality of basket ribs radially extending from said pole, and wherein said deflection chains include alternating first and second deflection members, wherein said first deflection members are attached at a first end at said canopy rib assembly and are attached at a second end to said second continuous chain, and wherein said second deflection members are attached at a first end to said first continuous chain at a position between said canopy ribs and at a second end to said basket ribs.

15. The target according to claim 14 wherein each of said basket ribs includes an extension rib and a support rib joining said extension rib to said pole, wherein each of said support ribs is angled downward from said pole by at least 15 degrees, and wherein said second deflection members are attached at said support ribs.

16. The target according to claim 13 wherein said canopy rib assembly and said basket assembly are fitted with removable skins.

17. A disc golf target, comprising:

a canopy assembly;

a basket assembly;

a chain assembly attached to said canopy assembly and to said basket assembly, wherein said chain assembly includes a plurality of deflection members; and wherein said canopy assembly and said basket assembly are fitted with removable skins.

18. A disc golf target, comprising:

a canopy assembly;

a basket assembly;

a chain assembly attached to said canopy assembly and to said basket assembly, wherein said chain assembly includes a plurality of deflection members; and wherein said deflection members include alternating first and second deflection members, wherein said first deflection members are attached at said canopy assembly and not directly to said basket assembly and said second deflection members are attached at said basket assembly and not directly to said canopy assembly.

* * * * *